US005673944A

United States Patent [19]

Walker et al.

[11] Patent Number: 5,673,944

[45] Date of Patent: Oct. 7, 1997

[54] BUSINESS FORM FOR INFORMATION RECORDING AND REPORTING

[75] Inventors: Lisa Walker, Portland, Oreg.; Wesley Nordlund, Bothell, Wash.

[73] Assignee: Uarco Incorporated, Barrington, Ill.

[21] Appl. No.: 663,630

[22] Filed: Jun. 14, 1996

[51] Int. Cl.[6] ..... B42D 15/00

[52] U.S. Cl. ..... 283/81; 283/901; 283/101; 283/105; 428/92.3

[58] Field of Search ..... 283/81, 901, 79, 283/100, 101–105; 40/299, 630; 428/40.1, 41.8, 42.2, 42.3, 43

[56] References Cited

U.S. PATENT DOCUMENTS

| | | | |
|---|---|---|---|
| 5,147,699 | 9/1992 | Browning et al. | 283/81 X |
| 5,328,208 | 7/1994 | Garrison | 283/81 X |
| 5,346,739 | 9/1994 | Nassory | 283/81 X |
| 5,573,277 | 11/1996 | Petkovsek | 283/81 X |

*Primary Examiner*—Willmon Fridie, Jr.
*Attorney, Agent, or Firm*—Wood, Phillips, VanSanten, Clark & Mortimer

[57] ABSTRACT

A business form adapted for both record keeping and the reporting of information includes a record ply (10) and a pressure sensitive adhesive label ply (12), (14), (16) overlying and secured to the record ply (10). The record ply (10) has a plurality of different record receiving locations (36), (38), (40), (42) at each of which variable information to be recorded may be inscribed. Fixed information 46 is inscribed on the record ply and identifies each of the recording receiving locations (36), (38), (40), (42). Die cuts (50) in the pressure sensitive adhesive label ply (12), (14), (16) are provided and are located to define a plurality of removable pressure sensitive adhesive labels (60), (62), (64), (66) that are aligned with corresponding ones of the record receiving locations (36), (38), (40), (42). Fixed information (76) is located on each of the labels and correlates with the fixed information (46) at the corresponding record receiving locations.

9 Claims, 5 Drawing Sheets

BUSINESS FORM FOR INFORMATION RECORDING AND REPORTING

FIELD OF THE INVENTION

This invention relates to business forms, and more particularly, to a business form that may be used for both the recording of information and the reporting of the information as, for example, to a third party.

BACKGROUND OF THE INVENTION

The State of Oregon has determined to improve the childhood immunization rate throughout the state to ultimately achieve complete and timely immunization of all children residing within the state. A major barrier to the state's achieving the goal has been its continuing inability to keep immunization records for each child accurate and up to date.

Desirably, the state would have the capability to automatically determine all immunizations due for each child entered in a data base. Working in collaboration with the Center for Medical Informatics at Yale University, the state is developing a rule based forecasting system based on the most current guidelines to identify needed immunizations for each child. The purpose is to allow forecasting capability to be available in health care provider's offices, facilitating the updating of records as new vaccines emerge and the immunization schedule changes. It is expected that the system would be able to generate automatic reminders by parents by phone and by postcard. This feature is anticipated to promote compliance with appointments and strengthen the patient-healthcare provider relationship.

Other potential benefits of the system include healthcare specific reports enabling more efficient follow-up on the patients; improved coordination between private and public health sectors; and ultimately, automatic issuing of immunization certificates for school registration, thereby reducing time and paperwork.

While these lofty goals can be highly automated, and therefore extremely complete and efficient, through the use of computers and associated data bases, a real problem involves the maintenance of immunization records that the healthcare provider and the simultaneous reporting of immunization information for entry into the applicable data base. To overcome this problem, it was proposed to provide a record sheet for keeping in the physician's office and having several entry locations wherein notation for each of several immunizations might be entered as each immunization was given. Each location was to be covered with an identifying tab held in place with repositionable adhesive, that is, the weak adhesive associated with note forms marketed under the trademark "Post-it". When an immunization was given, the corresponding tab is removed from the record sheet and placed on a card or the like for forwarding to the state, carrying with it the identity of the person and of the immunization type. The card would carry the approximate date on which the immunization was given. With the tab removed, the record sheet location can be completed by the care giver to assure the proper immunization record is available.

Unfortunately, this form had severe deficiencies to the point where it was essentially inoperable in the practical sense. The tabs could easily detach from the record sheet just in relatively routine handling. If lost as a result, then special, and time consuming, reporting is required.

Even more significant is the problem that arises if the tab, after being removed from the record sheet is affixed to the reporting card, is dislodged from the latter and becomes lost. In such a case, the care giver will be of the belief that the immunization has been properly reported, while the receiving agency will never know that the immunization has been given unless an extensive, and expensive periodic follow-up procedure is in place. Consequently, the potential for breakdown of the entire system is substantial and expensive manual intervention is required.

The present invention is directed to overcoming the above problem.

SUMMARY OF THE INVENTION

It is the principal object of the invention to provide a new and improved business form that may be used for simultaneously recording information for use in one information and for reporting the information to another location or to a third party. More specifically, it is an object of the invention to provide such a business form that is constructed so as to essentially prevent the recording of information without the simultaneous reporting of the same while assuring that reporting in fact occurs.

An exemplary embodiment of the invention achieves the foregoing objects in a business form construction for record keeping and recording purposes. The construction includes a record ply and a pressure sensitive adhesive label ply overlying and secured to the record ply. The record ply has a plurality of different record receiving locations at each of which variable information to be recorded may be inscribed. Fixed information is inscribed on the record ply identifying each of the record receiving locations. Die cuts are disposed in the pressure sensitive adhesive label ply and are located to define a plurality of removable pressure sensitive adhesive labels, one for and aligned with each of the record receiving locations. As a consequence, a record receiving location cannot have variable information inscribed therein without first removing the corresponding pressure sensitive adhesive label. Fixed information is located on each of the labels which correlates with the fixed information at the corresponding record receiving location.

As a consequence of the foregoing, when it is desired to record variable information at a particular location on the record ply, the corresponding pressure sensitive adhesive label must first be removed. It may be readily affixed to a card such as a postcard or the like for transmission to a person or organization to whom the information is to be reported. Thereafter, the information to be recorded may be inscribed on the record ply.

In the case of an immunization program such as that mentioned previously, at each record receiving locations, the record ply may include an identification of the type of immunization given, its number if in a sequence, manufacture and batch number, site of the injection if the immunization is given by injection, and a location to be initialed by the care giver. Elsewhere, the record ply may have information designating the patient receiving the immunization.

In the same type of system, each pressure sensitive adhesive label will contain information correlated with the type of immunization that is designated for the corresponding record receiving location on the business form and, for example, a bar code or other coded means that identifies the patient, as well as the type of immunization given in machine readable form.

The labels, individually or several at one time are delivered to the data input location for the system and are machine read into the data base. The time of receipt of the information may be used to generate information as to when the next immunization in a series is required and the lack of receipt of a label indicating that such immunization has been given can be utilized to generate a reminder that the immunization is necessary.

A data base may be readily assembled containing all information relevant to each patient initially entered into the system for any of a variety of purposes.

In a preferred embodiment, the pressure sensitive adhesive label ply is defined by a release liner secured to the record ply and face stock adhered to the release liner. The die cuts extend through both the release liner and the face stock.

Other objects and advantages of the invention will become apparent from the following specification taken in connection with the accompanying drawings.

DESCRIPTION OF THE PREFERRED EMBODIMENT

Figure 1:
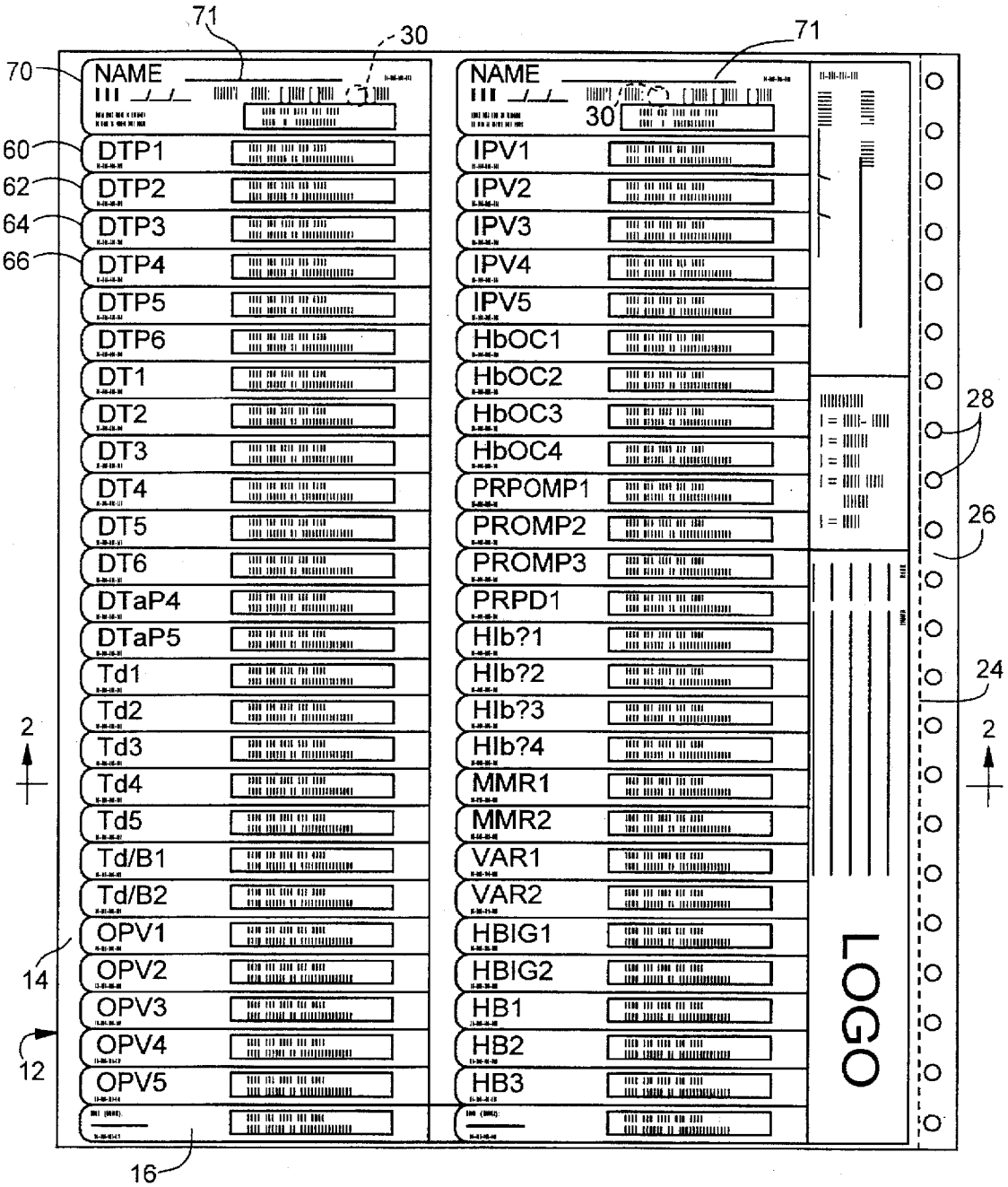
FIG. 1 is a plan view of a business form made according to the invention.

An exemplary embodiment of the business form adapted for record keeping and recording is illustrated in the drawings and will be described in the context of a form intended for the recording and reporting of immunizations. However, those skilled in the art will readily appreciate that the use of the form is not so limited. It will find utility in many other areas of endeavor where both record keeping and the reporting of the information are required.

Figure 2:
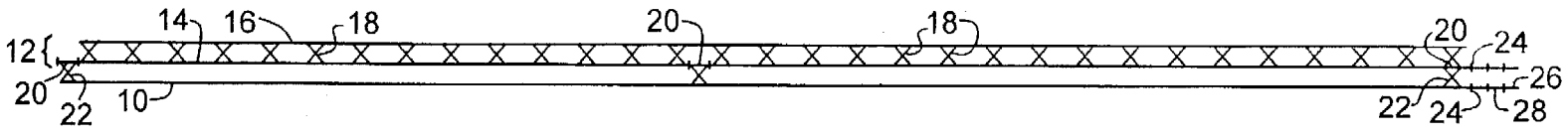
FIG. 2 is a somewhat schematic, sectional view taken approximately along the line 2—2 in FIG. 1.

Referring to FIGS. 1 and 2, the business form is made up of an underlying record ply 10 and an overlying pressure sensitive adhesive label ply 12 which is collectively made up of a release liner 14 and overlying face stock 16.

As is well known, the release liner 14 has an upper surface coated with a waxy material such as silicone to which pressure sensitive adhesive 18 releasably adheres. Thus, pressure sensitive adhesive 18 releasably secures the face stock 16 to the release liner ply 14.

As will be seen, the release liner ply 14 includes so called waste areas 20 which generally, but not always, will be those areas that do not have an overlying part of the face stock 16. An adhesive 22 at the waste areas 20 is used to adhere the release liner 14 to the record ply 10.

As can be seen in FIGS. 1 and 2, a longitudinal line of weakening 24 is located in both the release liner 14 and the record ply 10 along their right hand edges to define a removable control punch margin 26. The control punch margin 26 includes pin feed holes 28 which are used in the manufacturing process of the form as is well known. Generally, the control punch margin 26 will be removed before the form is sent to the customer.

Figure 3:
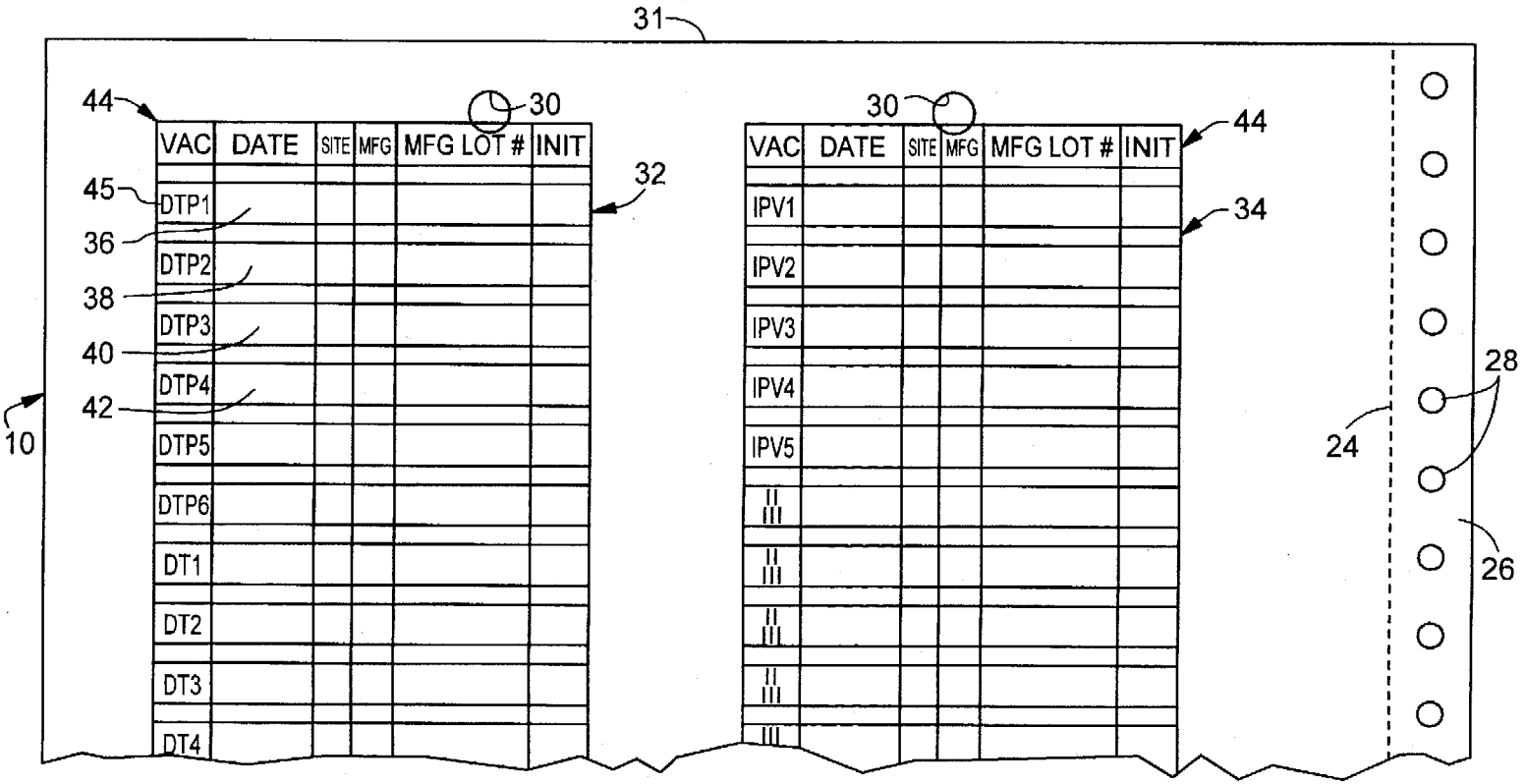
FIG. 3 is an enlarged, fragmentary plan view of a record ply used in the business form.

Turning now to FIG. 3, the record ply 10 is seen to include a pair of spaced holes 30 near its upper edge 31. The holes 30 may be employed to impale the business form on a conventional binder system. If desired, additional mounting holes could be located on the left side of the form.

Elsewhere, the record ply 10 is divided into two columns, generally designated 32 and 34 respectively. Each of the columns is a record information receiving location and is subdivided into several individual record receiving locations. For example, the column 32 has a first record receiving location 36, a second record receiving location 38, a third record receiving location 40, a fourth record receiving location 42, etc. At each of these locations, variable information is adapted to be manually inscribed. Manual inscription is not to be restricted to inscription through the use of a pen or pencil, but may include inscription as a result of operation of a typewriter, the operation of a computer printer operated in response to manual input of data, etc.

At the top of each of the columns 32 and 34 is a heading area, generally designated 44. Where the form is to be used in an immunization system, the legends shown in FIG. 3 may be employed which include the legend "VAC" to indicate the type of immunization given. Each of the record receiving areas 36, 38, 40, 42, below the heading "VAC" will have preprinted fixed information such as an identification of the type of immunization already inscribed thereon. That is to say, the designation "DTP 1 46" indicates that the first of a series of diphtheria-tetanus-pertussis immunizations was given.

The heading 44 also includes the legend "DATE" under which, the date of the immunization may be manually entered as mentioned previously. Next is the designation "SITE" under which an indication of the site or location on the body of the patient whereat the immunization was given.

The designation "MFG" can be used to receive an identification of the manufacturer of a vaccine and the following designation "MFG LOT#" allows for the entry of the specific lot number of the vaccine that was employed.

Finally, the designation "INIT" provides for entry of the initials of the person making the entry on the record.

Figure 4:
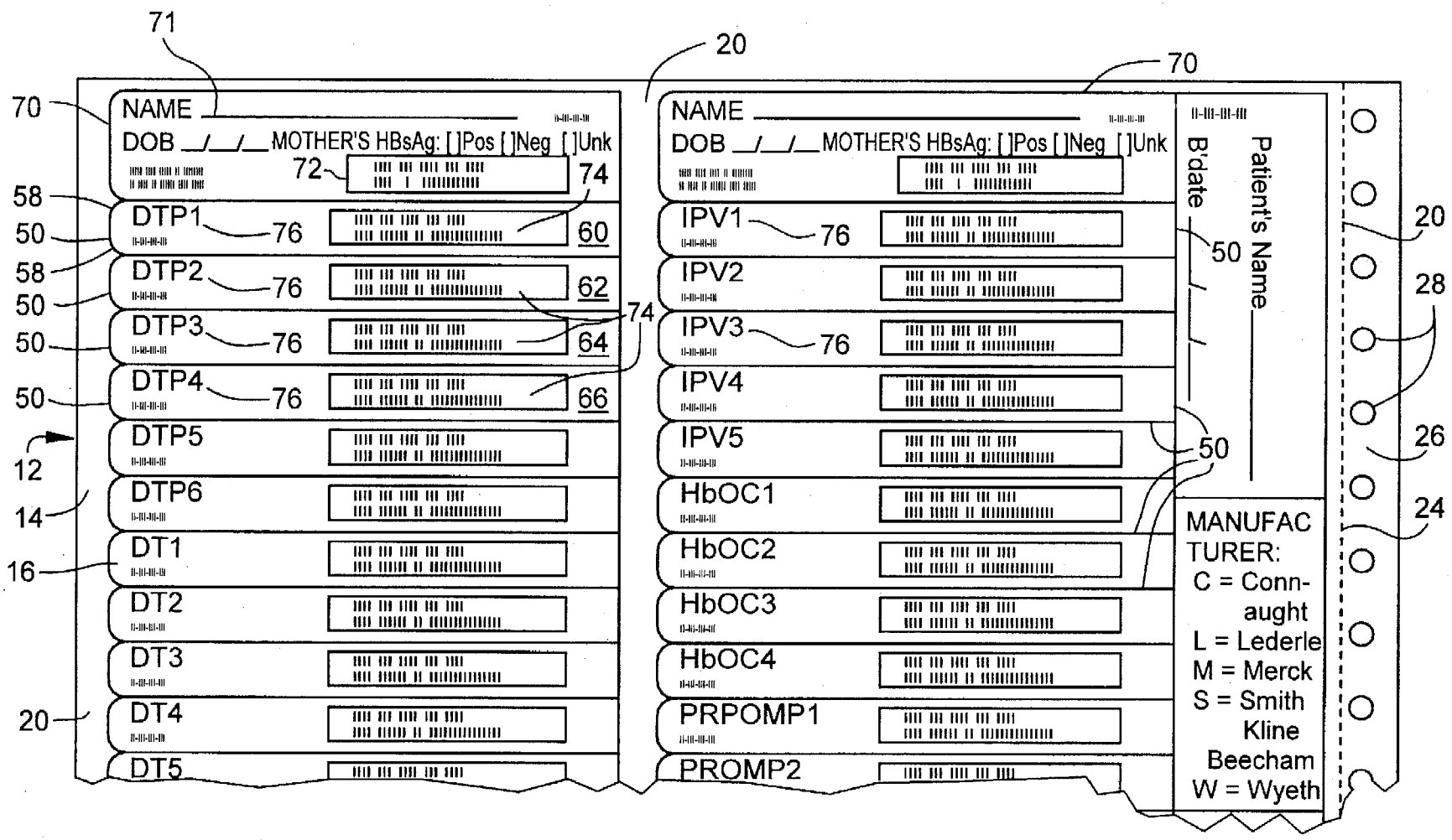
FIG. 4 is a view similar to FIG. 3 but of the release liner and associated face stock utilized in the business form with all information printed thereon.
Figure 5:
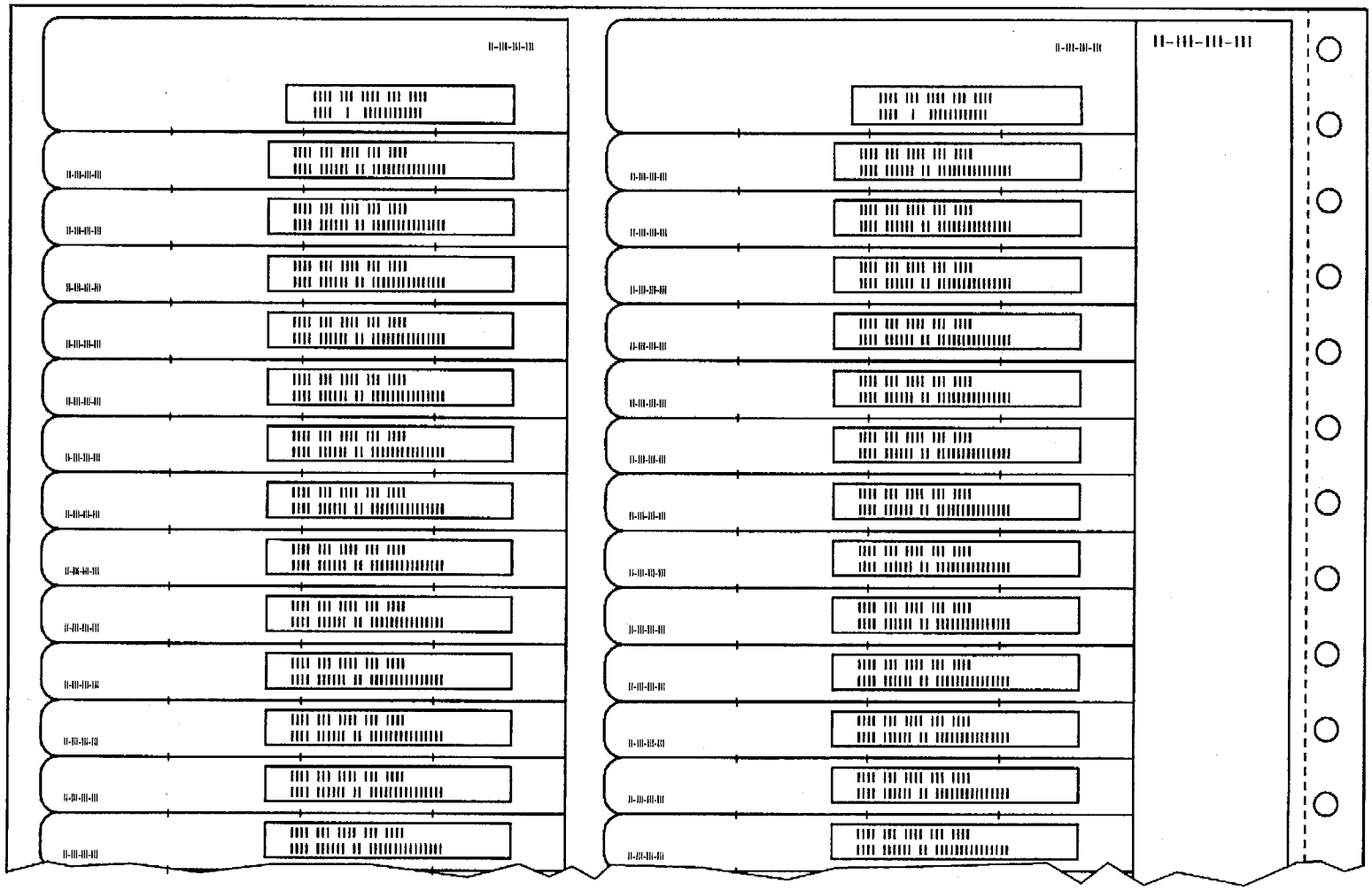
FIG. 5 is a view similar to FIG. 4 but omitting the fixed information that is printed on the face stock.

Turning now to FIG. 4, the pressure sensitive label ply 12 will be described in greater detail. The same includes a plurality of generally rectangular die cuts 50, 52, 54, 56, etc., which are generally closed die cuts and generally rectangular except for rounded corners 58 at their left hand edges. Each die cut defines a removable pressure sensitive label that is in overlying relation with and aligned with a corresponding one of the information receiving locations 36, 38, 40, 42, etc., on the record ply 10. Thus, the individual labels designated 60, 62, 64, 66, etc., respectively overlie the areas or locations 36, 38, 40, 42 on the record ply 10.

The die cuts 50, 52, 54, 56 are made in the face stock ply 16 as well as in the release liner ply 14 such that the die cuts in each are generally closed and aligned with one another. In the case of the face stock ply 16, all material exterior to the die cuts 50, 52, 54, 56 and other die cuts as will be seen is waste material and typically is removed, while in the case of the release liner 14, those parts outside of the die cuts define the waste areas 20.

Additional die cuts 70, which also extend through both the face stock 16 and the release liner 14 define somewhat larger labels 71 which may include the patient's name and other information along with a name bar code shown at 72 which identifies the patient. As can be seen in FIG. 1 or by comparing FIGS. 3 and 4, the larger labels 71 overlie the openings 30. Thus, before the business form can be mounted using the holes 30, it is necessary that the labels 71 be removed which in turn is a reminder that they should be completed and placed where directed as, for example, on the patient's identification form.

Returning to FIG. 4, each of the labels 60, 62, 64, 66 includes fixed information identification legend 76 which is correlated to the type of vaccination listed on the record ply as shown in FIG. 3. Thus, the label 60 includes the designation "DTP1 "; the label 62 includes the designation "DTP2"; the label 64 includes the designation "DTP3"; the label 66 includes the designation "DTP4"; etc. This information is termed fixed information because it is essentially unchanged from one form to the next on all forms that are put to the same use.

On the other hand, the bar code information shown at 72 on the label 71 and at 74 on the labels 60, 62, 64 and 66 is variable information because it changes from one label to the next. The bar code information will typically contain an identification of the patient and that part of the bar code will not change from one form to the next. However, the bar code will also include an indication of the type of immunization given and its location in the sequence and, of course, that information will change from one label to the next and hence is variable information. Code 128 bar code is preferred because its character of flexible variation of its alphanumeric encoding. In the bar code given at 74, for example, the information at the "AA" location will identify the form while the following "S" will indicate the shift character code. The next eight digits identify the form number which will be an identification of the patient. While this information will remain the same from one label to the next on a given form, it will change for each form. The "C" is a check digit used for conventional purposes. The "TTT" designation will contain the identification of the particular immunization given.

It will be recalled that the die cuts 50, 52, 54, 56 have been characterized as generally closed which is to say that they generally completely circumscribe a given area. The qualifying term "generally" is important here because small frangible ties interrupt each of the die cuts 50, 52, 54, 56 at certain locations. For example, and with reference to FIG. 6, the die cuts 50, 52, 54, 56 as they exist in the face stock 16 are interrupted by small frangible ties extending between adjacent ones of the labels. If desired, the ties 80 may be omitted. The ties 80 may be staggered and are sufficiently small that they are easily ruptured when a pressure sensitive adhesive label is removed from the form.

The dies cuts 50, 52, 54, 56 in the release liner 14 are also provided with small frangible ties 82 which extend between adjacent ones of the parts of release liner that define the individual labels as well as the waste sections 20 of the release liner 14.

Figure 6:
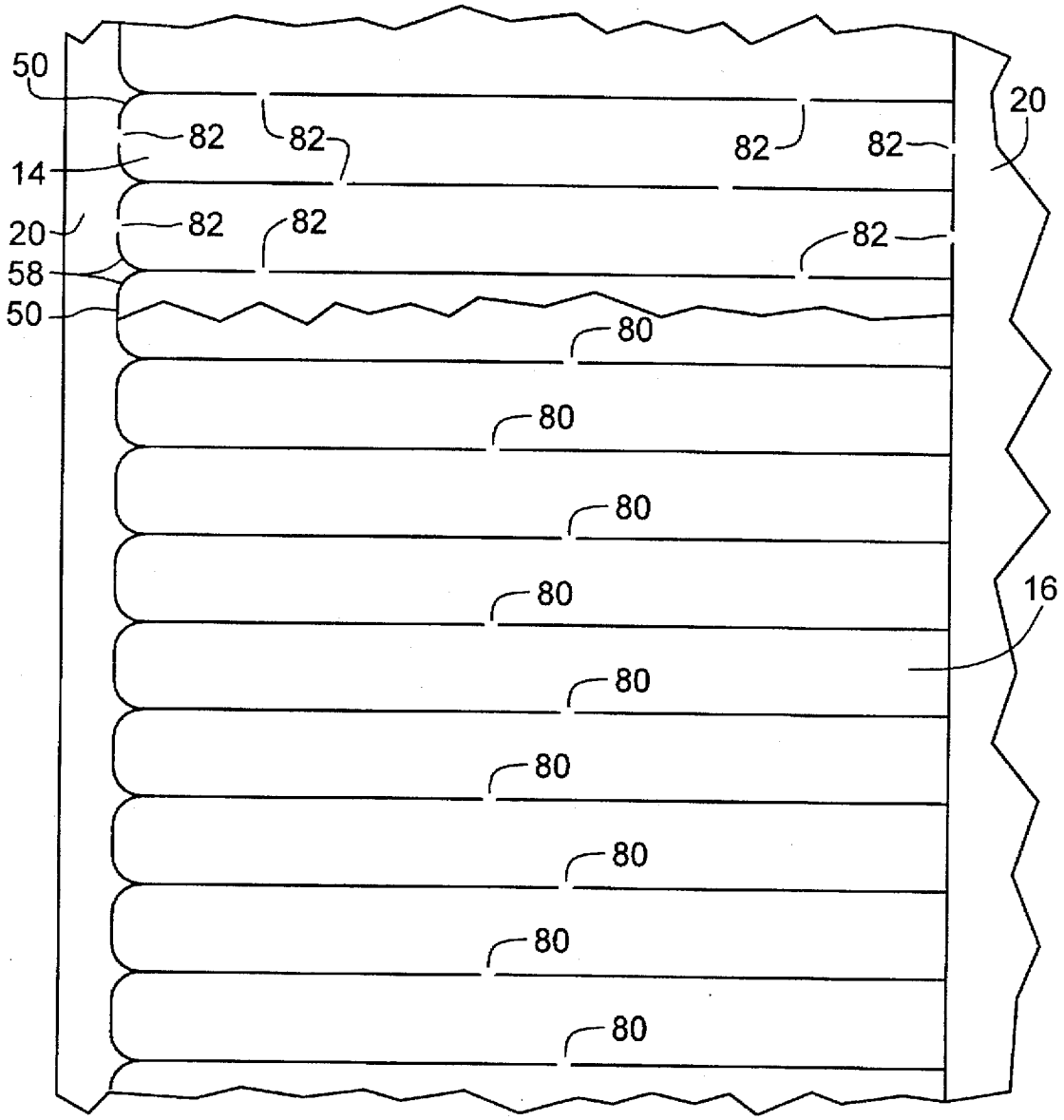
FIG. 6 is an enlarged, fragmentary view of part of the face stock as applied to the release liner ply with part of the former removed.

Preferably, the various ties 80 and 82 are staggered with respect to one another as illustrated in FIG. 6.

To remove a label, a right handed person will typically grasp one of the labels adjacent the rounded corners 58 thereof and lift the same from the form. The ties 80 and 82 will serially break as the label is pulled from the form, exposing the underlying record receiving area on the record ply 10. Because the ties 80, 82 are staggered, at any given time, only enough force to break a single one of the ties 80, 82 need be exerted, thereby eliminating the chance of damage to the label.

Once the label has been removed from the form, the data may be entered on the record ply 10 in the manner mentioned previously. The release liner section that adheres to the label that has been removed may be stripped from the label and the label then placed on a card or the like for subsequent delivery to the data collection point of the system.

Because the mounting holes 30 cannot be exposed without first removing the labels 71, the form design provides a strong encouragement to complete the labels 71 by filling in the requested information and then depositing those labels where directed. Similarly, because the record receiving locations on the record ply 10 cannot be completed without first removing the overlying label, there is again a strong encouragement to remove the label and place it on the card or whatever device is used to submit the same to the data collecting authority at the time a record of the immunization is being made.

Importantly, the use of pressure sensitive adhesive and the structure that makes such possible eliminates the problem of dislodged labels that occurs when the weaker, repositionable adhesive systems are used.

Thus, the business form is such as to provide a substantial impetus to the user to "do things right" in terms of performing all the acts that are necessary to assure that data is properly reported and records properly kept. Consequently, a business form for recording and reporting purposes that is ideally suited for use in the immunization tracking system being instituted by the State of Oregon is provided.

We claim:

1. A business form for record keeping and reporting purposes comprising:

a record ply; and a pressure sensitive adhesive label ply overlying and secured to said record ply;

said record ply having a plurality of different record receiving locations at each of which variable information to be recorded may be inscribed;

fixed information inscribed on said record ply identifying each of said record receiving locations;

die cuts in said pressure sensitive adhesive label ply and located to define a plurality of removable pressure sensitive adhesive labels, one for and aligned with each of said record receiving locations whereby a record receiving location cannot have variable information inscribed therein without first removing the corresponding pressure sensitive adhesive label; and fixed information on each of said labels correlating with the fixed information at the corresponding record receiving location.

2. The business form of claim 1 wherein said record ply has two spaced mounting holes near its top edge and wherein said pressure sensitive adhesive ply includes two additional die cut labels, one overlying one of said holes and the other overlying the other of said holes whereby said additional labels must be removed to expose said mounting holes.

3. The business form of claim 1 wherein said pressure sensitive adhesive label ply is defined by a release liner secured to said record ply and face stock adhered to said release liner by pressure sensitive adhesive; and said die cuts extend through both said release liner and said face stock.

4. The business form of claim 3 wherein at least the die cuts in said release liner are interrupted by small, frangible ties.

5. The business form of claim 3 wherein said die cuts are at least partially surrounded by waste areas of said release liner; and wherein said release liner is adhered at said waste areas to said record ply; and the waste area of said face stock is removed.

6. A business form for record keeping and reporting purposing comprising:

a record ply; and a pressure sensitive adhesive label ply overlying and secured to said record ply;

said record ply having a plurality of different record receiving locations at each of which variable information to be recorded may be inscribed;

fixed information inscribed on said record ply identifying each of said record receiving locations;

die cuts in said pressure sensitive adhesive label ply and located to define a plurality of removable pressure sensitive adhesive labels, one for and aligned with each of said record receiving locations whereby a record receiving location cannot have variable information inscribed therein without first removing the corresponding pressure sensitive adhesive label;

fixed information on each of said labels correlating with the fixed information at the corresponding record receiving location; and variable information inscribed on each label including a procedure identification and an identity identification.

7. A business form for record keeping purposes comprising:

a record ply having a plurality of preprinted record receiving locations at each one of which variable information to be recorded may be inscribed;

a release liner overlying and secured to said record ply and having a plurality of generally closed die cut areas one for each of said record receiving locations, each of said die cut areas further being aligned with a corresponding one of said record receiving locations;

a face stock ply overlying said release liner ply and having a plurality of generally closed die cut areas, each aligned with a corresponding one of said die cut areas in said release liner ply to define a plurality of labels, one for each of said record receiving areas, each of said labels having a unique, machine readable code thereon correlating the label to the corresponding preprinted record receiving location on said record ply; and pressure sensitive adhesive adhering said labels to said release liner.

8. The business form of claim 7 wherein said release liner ply includes waste areas in addition to the die cut areas thereof and said waste areas are adhered to said record ply.

9. The business form of claim 7 wherein said face stock ply consists essentially of the die cut areas thereof.

* * * * *